US005765735A

United States Patent [19]

Kimchi et al.

[11] Patent Number: 5,765,735

[45] Date of Patent: Jun. 16, 1998

[54] COMBINATION SHOULDER STRAP AND ANATOMICAL PAD

[76] Inventors: Nitzan Kimchi, 8 Itamar Ben Avi Street; Dror Tishler, 55 Chail Ha-avir Street, both of Jerusalem, Israel

[21] Appl. No.: 699,497

[22] Filed: Aug. 19, 1996

[30] Foreign Application Priority Data

Aug. 21, 1995 [IL] Israel ..... 115010

[51] Int. Cl.[6] ..... A41F 15/02

[52] U.S. Cl. ..... 224/264; 3/327

[58] Field of Search ..... 224/264, 265, 224/266, 257, 600, 643; D3/327; 2/268, 267, 460

[56] References Cited

U.S. PATENT DOCUMENTS 3,799,413 3/1974 McBain ..... 224/264

5,267,680 12/1993 Torok ..... 224/264 X

OTHER PUBLICATIONS

"Backsaver" advertisement from Smithsonian Magazine, Jul. 1997.

*Primary Examiner*—Renee S. Luebke

*Attorney, Agent, or Firm*—Baker & Botts, L.L.P.

[57] ABSTRACT

The invention provides a combination shoulder strap and anatomical pad to be used on a carrying bag, comprising a pad, configured to rest on a shoulder of a user and to diverge from an apex at the meeting point of the pad and the user's shoulder, a strap comprising two diverging strap segments, wherein the longitudinal axes of the strap segments meet at an obtuse angle in the area of the apex of the pad, the transverse width of the pad being narrower in the area of the apex by virtue of an indentation formed in the pad within the confines of the formed obtuse angle, the pad being further provided with padding material positioned within each diverging segment of the pad adjacent the narrowed area and the padding being graduated in thickness along its width and having a maximum thickness in the areas bracketing the indentation.

5 Claims, 4 Drawing Sheets

COMBINATION SHOULDER STRAP AND ANATOMICAL PAD

The present invention relates to a combination shoulder strap and an anatomical pad. More particularly, the present invention provides a shoulder strap and an anatomical pad which is specially configured to the user's shoulder, to be used for carrying various items such as satchels, suitcases and the like.

Carrying bags are commonly attached to a shoulder strap in order to enable the user to carry a load farther and more comfortably than would be possible if the user were carrying the load by hand. In addition, a shoulder strap frees the user's hands for other purposes.

The apparent advantages of a shoulder strap are reduced by several factors: A person's shoulder is naturally slanted, having its lowest point at its outer edge. Therefore, when a person is carrying a load by means of a shoulder strap, the load tends to create a pulling pressure on the strap, causing it to move towards the low point and slip off the user's shoulder. Aside from the fact that such slippage is a nuisance in itself, the user is also required to use one hand to hold the shoulder strap, or the bag supported thereby, to prevent the same from slipping; thus, the user is prevented from using that hand for other functions. In addition, the slanting of the shoulder causes an angular positioning of the strap, which then, due to gravity, creates an uneven weight distribution. The weight differential within the width of an ordinary shoulder strap may cause a great deal of pressure to the user's neck area and, in some cases, may also cause a regional shoulder numbness as a result of reduced blood circulation. Furthermore, when a bag is being supported by an ordinary shoulder strap it starts moving from side to side in a pendulum-like fashion. This movement may cause the carrier to lose balance and fall, especially when the load is heavy. If the shoulder strap is positioned in a cross-body fashion, i.e., it is placed on the user's shoulder opposite the side where the bag is being carried, slippage of the strap does not occur, but the other problems mentioned above are still prevalent.

Therefore, one of the objects of the present invention is to obviate the disadvantages of the prior art shoulder straps and to provide a shoulder strap having an anatomical pad which is more suitable to its task, thereby allowing the carrying of loads over a longer distance in a more comfortable, safer manner.

The present invention achieves the above objectives by providing a combination shoulder strap and anatomical pad to be used on a carrying bag, comprising a pad, configured to rest on a shoulder of a user and to diverge from an apex at the meeting point of said pad and said user's shoulder; a strap comprising two diverging strap segments, wherein the longitudinal axes of said strap segments meet at an obtuse angle in the area of said apex of said pad, the transverse width of the pad being narrower in the area of said apex by virtue of an indentation formed in the pad within the confines of said formed obtuse angle; said pad being further provided with padding material positioned within each diverging segment of said pad adjacent said narrowed area; and said padding being graduated in thickness along its width and having a maximum thickness in the areas bracketing said indentation.

In a first preferred embodiment of the present invention, there is provided a combination shoulder strap and anatomical pad as defined above, wherein said two diverging strap segments are formed of a single strap, folded and joined to form an obtuse angle at said apex of said pad.

In a second preferred embodiment of the present invention, there is provided a combination shoulder strap and anatomical pad as defined above, wherein said two diverging straps segments are formed of two separate straps joined to each other at an obtuse angle at said apex of said pad.

In a third preferred embodiment of the present invention, there is provided a combination shoulder strap and anatomical pad as defined above, wherein said two diverging strap segments are respectively joined to the opposite ends of said pad.

In a further preferred embodiment of the present invention, there is provided a combination shoulder strap and a anatomical pad, wherein said pad is provided with an additional layer of padding of uniform height.

Yet further embodiments of the invention will be described hereinbelow.

The benefits achieved by the present invention include a smaller chance that the strap will slip off the user's shoulder; a reduced amount of friction; a reduced amount of pressure to the shoulders and neck, due to the increased surface area and a better weight distribution; and a smaller chance that the user will lose his balance and fall.

The invention will now be described in connection with certain preferred embodiments with reference to the following illustrative figures so that it may be more fully understood.

With specific reference now to the figures in detail, it is stressed that the particulars shown are by way of example and for purposes of illustrative discussion of the preferred embodiments of the present invention only, and are presented in the cause of providing what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how the several forms of the invention may be embodied in practice.

Figure 4:
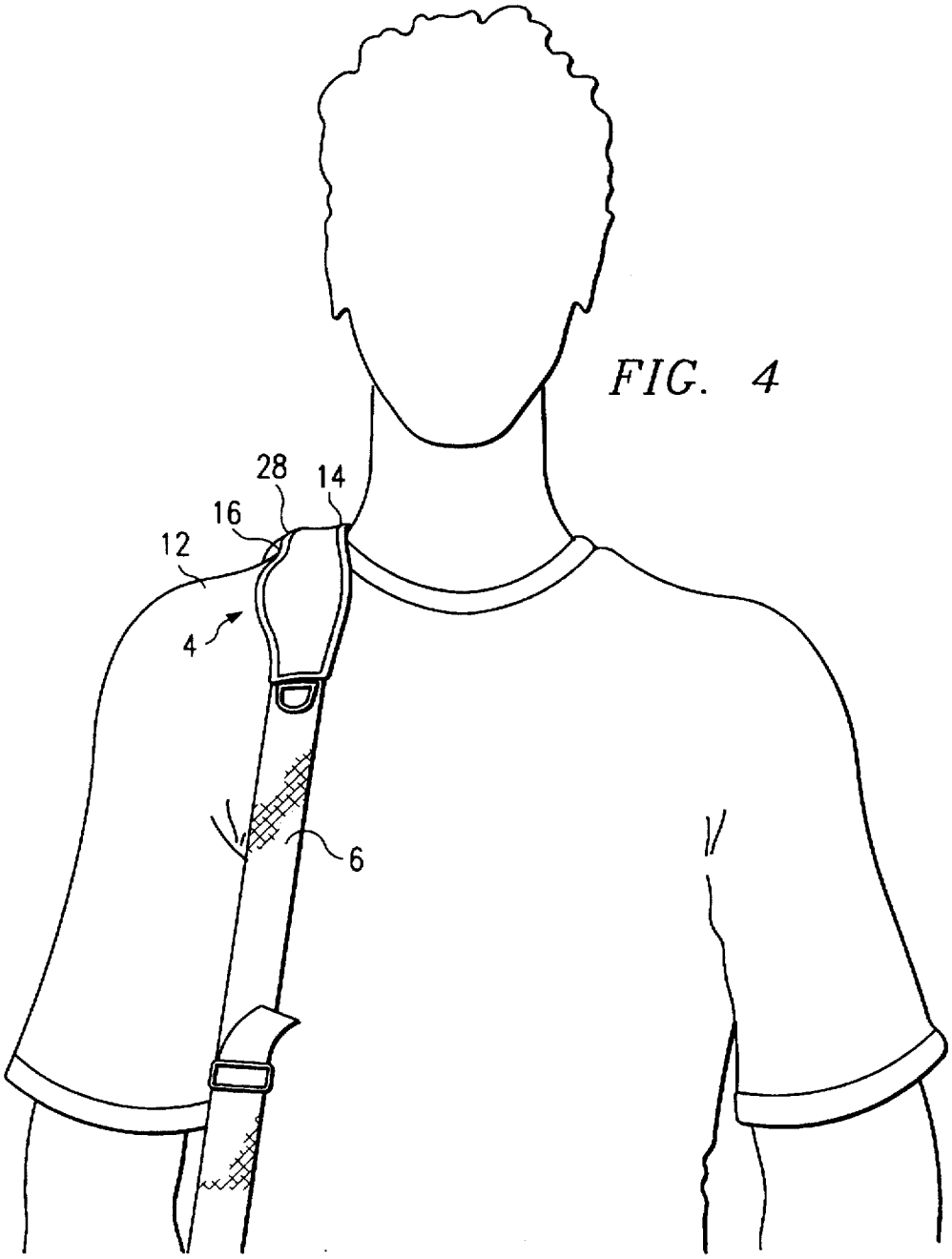
FIG. 4 is a front view of a combination strap and pad according to the invention, placed on the user's shoulder on the side where the bag is being carried.
Figure 4A:
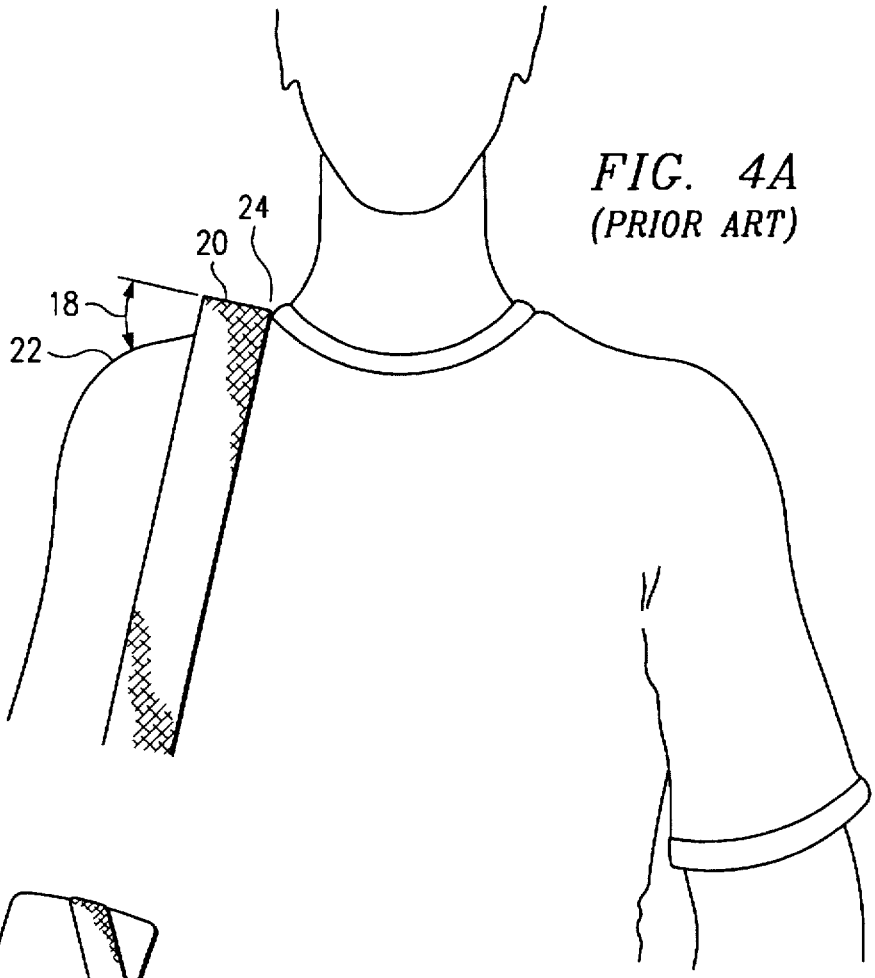
FIG. 4A (PRIOR ART)

FIG. 4*a* is a schematic illustration of the meeting point between an ordinary prior art shoulder strap and the user's shoulder.

Figure 5:
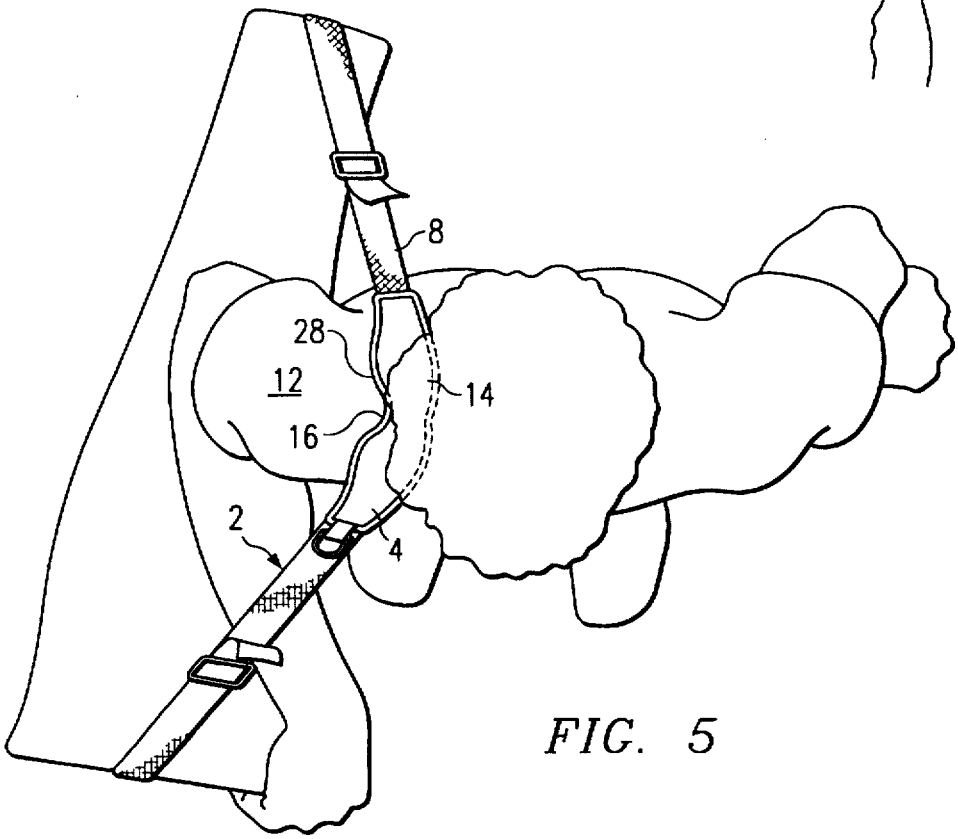
Figure 6:
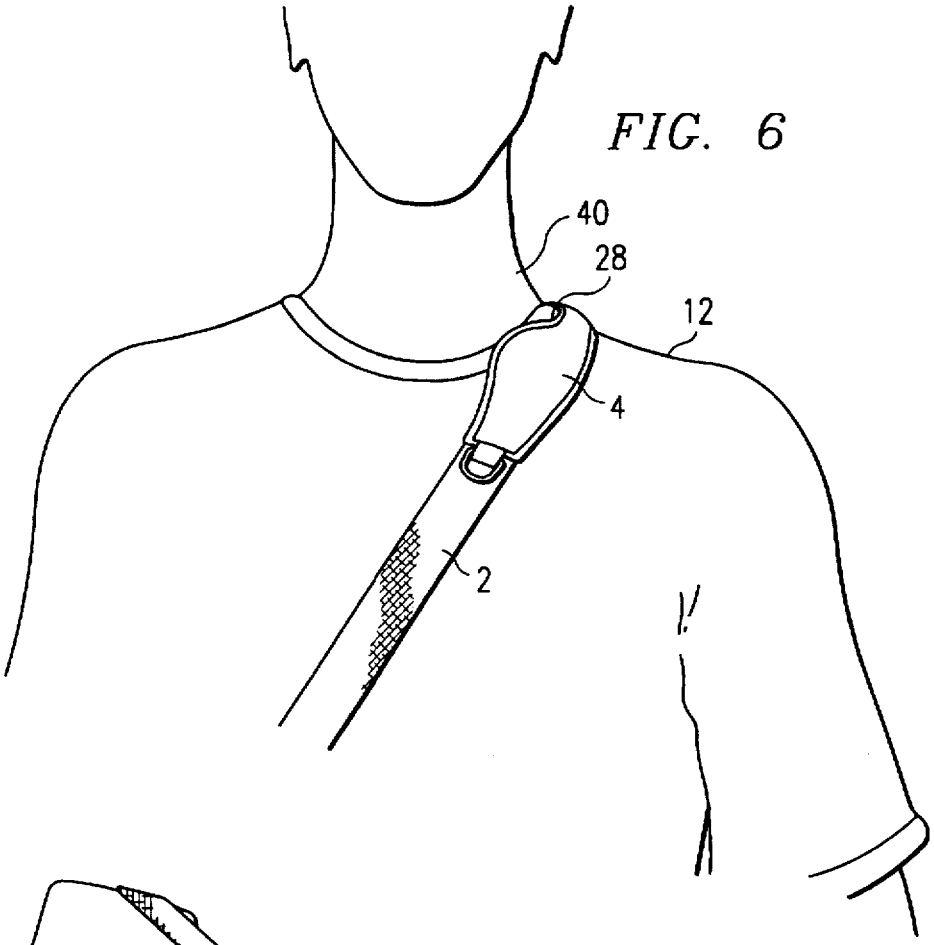
Figure 7:
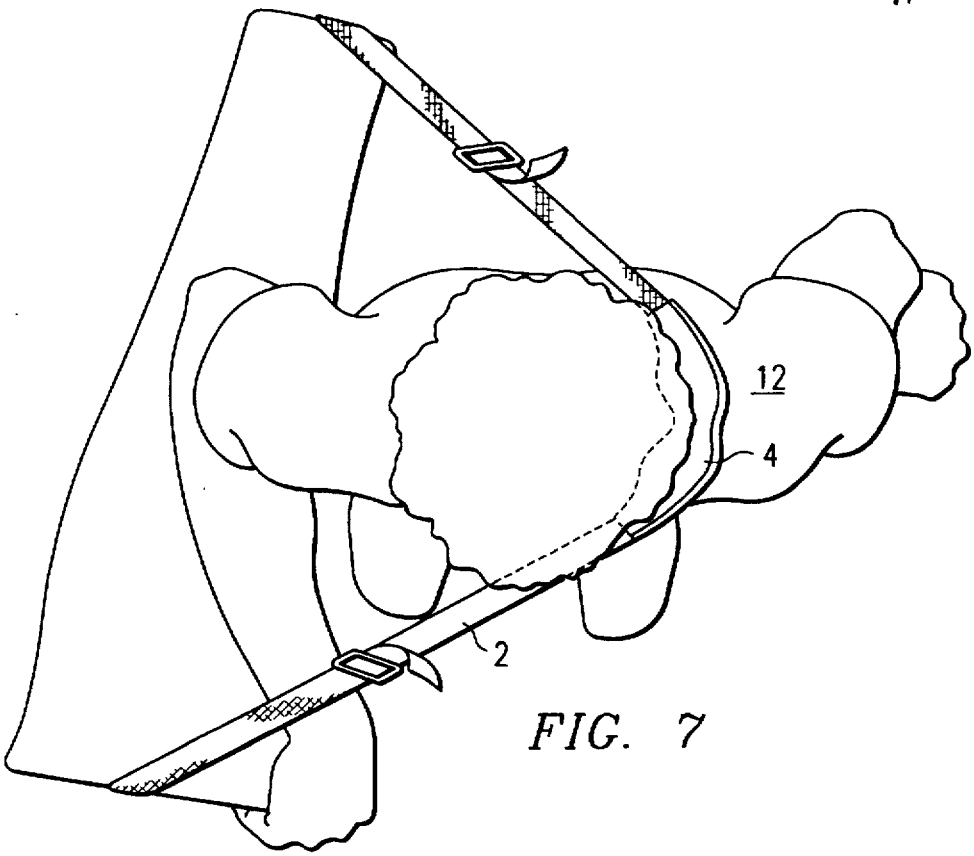

FIG. 5 is a top view of the combination strap and pad of FIG. 4;

FIG. 6 is a front view of a combination strap and pad according to the invention, placed on the user's shoulder opposite the side where the bag is being carried;

FIG. 7 is a top view of the combination strap and pad of FIG. 6; and

Figure 1:
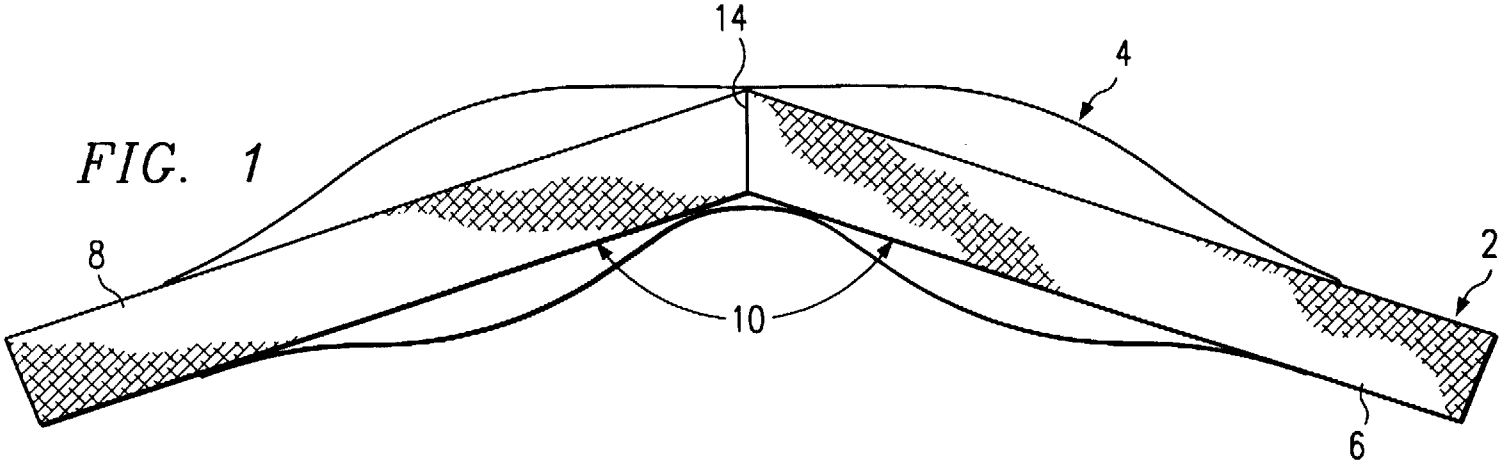
FIG. 1 is a top view of a combination shoulder strap and anatomical pad according to the invention without its fabric cover, showing the attachment of the strap to said anatomical pad.
Figure 2:
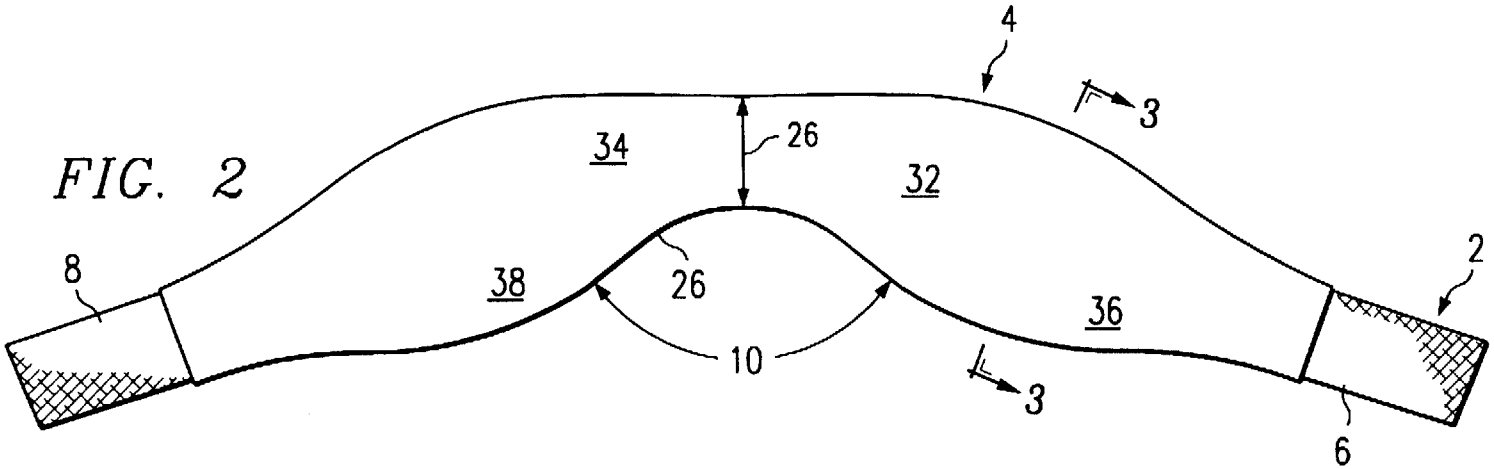
FIG. 2 is a top view of the combination strap and pad of FIG. 1 with the fabric covering in place.

Referring now to FIGS. 1 and 2, there are seen views of a combination shoulder strap 2 and anatomical pad 4 according to the present invention, wherein said strap comprises two diverging strap segments 6 and 8 which meet at an obtuse angle 10. Said pad 4 is configured to rest on the shoulder 12 of a user, as seen e.g. with reference to FIG. 4, and to diverge from an apex 14 at the meeting point 16 thereof with said user's shoulder 12, as seen in FIGS. 4 and 5.

Obtuse angle 10, during use of the strap, is located at the highest point of the user's shoulder, i.e. at meeting point 16 as seen in FIGS. 4 and 5, and enables the strap to have a greater surface of contact at that high point.

In contradistinction, in an ordinary shoulder strap, as shown with reference to comparative FIG. 4*a*, an angle 18 is formed between the strap 20 and shoulder 22, causing a single contact point 24 in cross-section, or a contact line instead of a full contact area.

Referring again to FIGS. 1 and 2, the angle 10 between the strap segments 6 and 8 may be formed either by the folding of a single strap, folded and joined to form an obtuse angle at said apex of said pad (not shown), and preferably within the pad 4, or by the connection of two separate strap segments 6 and 8 joined to each other at an obtuse angle 10 at said apex 14 of said pad 4.

As can be seen better with reference to FIG. 2, the transverse width 26 of the pad 4 is narrower in the area of said apex 14 by virtue of an indentation 28 formed in the pad within the confines of said obtuse angle 10.

With reference to the rest of the figures, similar reference numerals have been used to identify similar parts.

Figure 3:
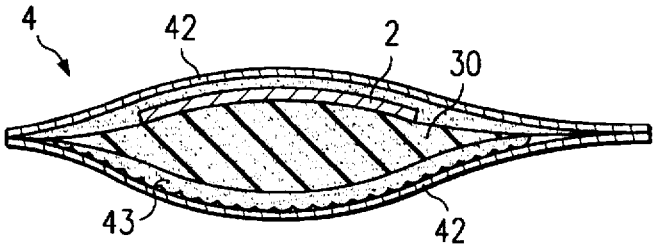
FIG. 3 is a cross-sectional view of the covered strap and pad, showing the various layers therein, taken along 3—3 of FIG. 2.

Referring now to FIG. 3, which is a cross-section of pad 4 taken along line 3—3, it can be seen that said pad 4 is further provided with padding material 30 which is positioned within each diverging segment 32 and 34 of said pad, adjacent said narrowed area 26 (FIG. 2), said padding 30 being graduated in thickness in its width along line 3—3, and having a maximum thickness in the areas 36 and 38 (FIG. 2) bracketing said indentation.

The indentation 28 (FIG. 2) is configured so that, in the case of cross-body carrying, as shown with reference to FIG. 6, the padding 4 partly surrounds the user's neck 40 and does not rub against or cut it.

The strap 2 and said padding material 30 are surrounded with a layer of fabric 42 made of synthetic fibers (nylon, polyester, etc.), natural fibers (cotton, etc.), leather, or any other strong material which is not hard or stretchable. Strap 2 is located below said surrounding fabric 42. As stated and illustrated, below strap 2 is a gruaduated padding material 30. Under said padding material 30 is an additional layer of padding material 43 of uniform height. Other embodiments (not shown) may include additional layers of padding between strap 2 and said graduated padding 30, and/or between padding 43 and the bottom surrounding fabric layer 40, as well as the addition of at least one adjustable air pocket (not shown).

The anatomical structure of pad 4, as described hereinbefore, involving the utilization of padding of graduated thickness, enables the participation of the shoulder's vertical parts in the weight distribution, provides an increased area of friction, and utilizes the hollow space between the sternum and the shoulder as an appropriate resting place for the shoulder strap, thus preventing its slipping off the shoulder when the bag is being carried in an ordinary fashion, i.e., when the strap is placed on the user's shoulder on the side where the bag is being carried as illustrated in FIG. 4.

As will be realized, the graduated thickness of the humped center padding 30 constitutes an especially important feature of the present invention. The lack of symmetry in the shape of padded center hump 30 is designed to fill the angle differential between the slope of the shoulder of the user and the strap 2. Thus, the two diverging segments 32 and 34 (FIG. 2) of the pad 4 will fill the hollow between the chest and the sternum and the vertical shoulder surface, and the space between the shoulder blades of the user, respectively. In the case of cross-body carrying, the hump also improves the padding in the neck area and reduces friction to the neck 40 (FIG. 6). The surrounding fabric layer 42 (FIG. 3) comes into contact with the user's body and should therefore be pleasant and soft to the touch, elastic, sweat-absorbent and have a friction coefficient which is adequate for preventing its slippage.

FIGS. 4 and 5 illustrate the combination shoulder strap 2 and anatomical pad 4 in use, while a bag is being carried on the user's shoulder 12 on the side where the bag is being carried. As shown, the indentation 28 of the shoulder strap embraces the carrier's shoulder, while the angle 10 (FIGS. 1 and 2) enables the placement of the strap 2 substantially along the longitudinal axis of the user's body.

FIGS. 6 and 7 illustrate the combination strap 2 and anatomical pad 4 of the present invention being used in the cross-body position. In this case the bag will not slip off the shoulder 12. As can be seen, the strap's configuration promotes a better weight distribution throughout the entire area of contact between the shoulder and the strap, indentation 28 partly surrounding the user's neck 40, thus reducing friction thereon, and the unique shape of pad 4, center hump 30 (not shown), and the padding layer 42 (not shown) enabling the padding and filling-in of spaces between the combination shoulder strap and anatomical pad and the user's back and chest.

It will be evident to those skilled in the art that the invention is not limited to the details of the foregoing illustrated embodiments and that the present invention may be embodied in other specific forms without departing from the spirit or essential attributes thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed is:

1. A combination shoulder strap and anatomical pad to be used on a carrying bag, comprising:

a pad, configured to rest on a shoulder of a user and to diverge from an apex region where said pad meets said user's shoulder;

a strap comprising two diverging strap segments, wherein the longitudinal axes of said strap segments meet at a fixed obtuse angle in the apex region, said pad having a transverse width being narrower in the apex region by virtue of an indentation formed in the pad within the confines of said formed obtuse angle;

said pad being further provided with padding material positioned within said pad adjacent the apex region; and said padding material being graduated in thickness along its width and having a maximum thickness in areas bracketing said indentation.

2. A combination shoulder strap and anatomical pad according to claim 1, wherein said pad is further provided with an additional layer of padding of uniform height.

3. A combination shoulder strap and anatomical pad according to claim 1, wherein said two diverging strap segments are formed of a single strap, folded and joined to form an obtuse angle at said apex region of said pad.

4. A combination shoulder strap and anatomical pad according to claim 1, wherein said two diverging strap segments are formed of two separate straps joined to each other at an obtuse angle at said apex region.

5. A combination shoulder strap and anatomical pad according to claim 1, wherein said two diverging strap segments are respectively joined to opposite ends of said pad.

* * * * *